US010350614B2

(12) United States Patent
Burford et al.

(10) Patent No.: US 10,350,614 B2
(45) Date of Patent: Jul. 16, 2019

(54) SELF-CLEANING CENTRIFUGAL SEPARATOR

(71) Applicant: MANN+HUMMEL GMBH, Ludwigsburg (DE)

(72) Inventors: Nigel Burford, Taunton (GB); Anthony W. Fell, Yeovil (GB); Angus Rouse, Frittenden (GB)

(73) Assignee: MANN+HUMMEL GmbH, Ludwigsburg (DE)

( * ) Notice: Subject to any disclaimer, the term of this patent is extended or adjusted under 35 U.S.C. 154(b) by 340 days.

(21) Appl. No.: 15/216,906

(22) Filed: Jul. 22, 2016

(65) Prior Publication Data

US 2017/0008011 A1 Jan. 12, 2017

Related U.S. Application Data

(63) Continuation of application No. PCT/EP2015/050789, filed on Jan. 16, 2015.

(30) Foreign Application Priority Data

Jan. 22, 2014 (GB) ..... 1401033.4

(51) Int. Cl.
*B04B 3/00* (2006.01)
*B04B 15/06* (2006.01)
(Continued)

(52) U.S. Cl.
CPC ..... *B04B 3/00* (2013.01); *B04B 5/005* (2013.01); *B04B 7/02* (2013.01); *B04B 9/12* (2013.01); *B04B 11/02* (2013.01); *B04B 15/06* (2013.01)

(58) Field of Classification Search
CPC .. B04B 3/00; B04B 15/06; B04B 9/12; B04B 11/02; B04B 7/02; B04B 5/005
See application file for complete search history.

(56) References Cited

U.S. PATENT DOCUMENTS 3,682,373 A 8/1972 Mercier
4,302,332 A 11/1981 Hayakawa
(Continued)

FOREIGN PATENT DOCUMENTS

CN 201006492 Y 1/2008
CN 102614999 A 8/2012
(Continued)

OTHER PUBLICATIONS

The International Preliminary Report on Patentability (Chapter I) for PCT/EP2015/050789, dated Jul. 2016.*
(Continued)

*Primary Examiner* — David A Reifsnyder
(74) *Attorney, Agent, or Firm* — James Hasselbeck

(57) ABSTRACT

A centrifugal separator is provided with a base and a substantially vertical spindle upstanding from the base. A rotary vessel is mounted on the spindle. A housing is connected to the base and encloses the rotary vessel. A liquid supply duct supplies a liquid to be filtered to the rotary vessel. The rotary vessel has an open top and an upper edge at the open top. The rotary vessel is provided with a filter material and has a weir arranged at the upper edge, wherein the filter material extends upwardly to the weir. The housing has a passageway adjacent to the weir and the passage way communicates with the weir to enable discharge of waste material that is contained in the liquid to be filtered and does not pass through the filter material during supply of liquid to be filtered to the rotary vessel and rotation of the rotary vessel.

19 Claims, 3 Drawing Sheets

(51) Int. Cl.

| | |
|---|---|
| ***B04B 9/12*** | (2006.01) |
| ***B04B 11/02*** | (2006.01) |
| ***B04B 7/02*** | (2006.01) |
| ***B04B 5/00*** | (2006.01) |

(56) References Cited

U.S. PATENT DOCUMENTS

| | | | |
|---|---|---|---|
| 4,640,772 | A | 2/1987 | Graham |
| 5,163,895 | A | 11/1992 | Titus |
| 5,904,841 | A | 5/1999 | Penny |
| 6,364,822 | B1 | 4/2002 | Herman |
| 2012/0122650 | A1 | 5/2012 | Bartsch |
| 2012/0329630 | A1 | 12/2012 | Hoffmann |
| 2013/0005559 | A1 | 1/2013 | Burford et al. |

FOREIGN PATENT DOCUMENTS

| | | | |
|---|---|---|---|
| FR | 2076527 | A6 | 10/1971 |
| FR | 2596620 | A1 | 10/1987 |
| GB | 2478578 | A | 9/2011 |
| JP | 2003071322 | A | 3/2003 |

OTHER PUBLICATIONS

The International Search Report for PCT/EP2015/050789, dated Mar. 2015.*

* cited by examiner

SELF-CLEANING CENTRIFUGAL SEPARATOR

CROSS-REFERENCE TO RELATED APPLICATIONS

This application is a continuation application of international application No. PCT/EP2015/050789 having an international filing date of 16 Jan. 2015 and designating the United States, the international application claiming a priority date of 22 Jan. 2014, based on prior filed British patent application GB 1401033.4, the entire contents of the aforesaid international application and the aforesaid British patent application being incorporated herein by reference.

BACKGROUND OF THE INVENTION

This invention relates to a centrifugal separator, also known in the art as a "centrifugal filter", which is designed so that it will operate in a manner achieving a self-cleaning effect.

Centrifugal separators are well known for separating liquids of different densities or for separating particulate matter from liquids. The principle of operation of such a centrifugal separator is that a housing contains a rotor which is supported therein to spin at high speed about a substantially vertical axis. Liquid from which contaminants are to be removed is supplied to the rotor at elevated pressure along the axis of rotation. As this liquid passes through the rotor, denser contaminant materials or particles are separated therefrom centrifugally and retained in the rotor, typically as a cake adhering to the interior surface of the rotor, which is cleaned or replaced at intervals.

Self-powered centrifugal separators in which the liquid from which contaminants are to be removed also provides the drive for the rotor have long been used in lubrication systems of vehicles, as well as in other industrial separation processes. GB 2160796 and GB 2296942 disclose self-powered centrifugal separators of the type which comprises a base, a substantially vertical spindle upstanding from the base, a rotor mounted on the spindle for rotation thereabout by reaction to liquid emission from rotor nozzles, the base having an inlet passage for said liquid and the spindle having an axial bore and outlets therefrom to supply liquid to the rotor from said inlet passage, and a cover mounted on the base and enclosing the rotor. In this type of separator the liquid is supplied at pressure from the base of the housing and flows upwards through the axial bore to outlets near the top of the bore, which is typically a blind bore. A releasable cap is typically mounted at the top of the spindle to secure the cover.

In its earlier GB2478578 A, the applicant disclosed a centrifugal separator, whether of the self-powered type or when powered independently of the liquid being filtered, specifically designed to enable abrasive contaminant particles to be separated and removed from a liquid. Such abrasive contaminant particles need to be removed from liquid in a variety of industrial processes, including from honing oil, grinding machine coolant, electrode discharge machining fluid, or oil quench fluid from furnaces, and in water purification processes. In a more specific example a centrifugal separator may be used to remove particulate matter from cooling liquids used in industrial cutting processes. Waste materials generated in the cutting process mix with the cooling liquid and must be removed if the liquid is to be recycled. Failure to remove accumulating waste material will reduce the effectiveness of the cooling liquid and could result in overheating of cutting process components.

In order to prevent abrasive particles contacting the rotor bearings and causing rapid wear of the bearings, sometimes after as little as 30 seconds operation, and in order to separate contaminant particles from a liquid which is not itself a lubricant, the rotor and the spindle are connected so as to rotate in unison and bearings for rotation of the spindle relative to the base are provided in a bearing housing fixed to the base so that the bearings are isolated from the rotor chamber through which the liquid passes and on the inner surface of which the contaminant particles are retained. An axial sealing arrangement, separate from the rotational bearings, and between the spindle and the base is also disclosed in GB 2478578 A.

All of the foregoing centrifugal separators are designed for continuous operation, i.e. continuous through flow of liquid from which contaminant particles are to be removed. In the case of self-driven centrifugal separators in vehicle lubrication systems the cake of contaminant particles formed on the interior surface of the rotor is typically cleaned out manually during annual or half yearly servicing. Single use, removable and discardable rotor linings have been proposed and used for this purpose in some circumstances to save on the labour time and general messiness of this cleaning operation.

In some situations in vehicle or other industrial engines, rotors of centrifugal separators may need to be cleaned out every month, or two or more times a month for maintaining effective trouble-free operation. However, in other situations where centrifugal separators are used, such as for separation of abrasive particles from cooling liquid in metal cutting operations, sludge-like deposits of contaminant may build up so quickly in the rotor that cleaning out every day or even several times a day is necessary or desirable. Not only is this time consuming, but the speed and efficiency of the dismantling and re-assembly operations depend on the skill of the operating personnel. As the balance of the rotor must be accurately re-established at each re-assembly, this may not be efficiently and effectively achieved, nor in a predictable time scale.

An object of the invention is at least to reduce the frequency of cleaning out of the interior of the rotor of a continuously operating centrifugal filter, in situations where quick or heavy build-up of contaminant debris occurs. A further object is to reduce to a minimum the requirement for cleaning out the rotor of a centrifugal separator which operates in a liquid line of continuous process activity.

SUMMARY OF THE INVENTION

In accordance with a first aspect, the present invention provides a centrifugal separator comprising a base, a substantially vertical spindle upstanding from the base, a rotary vessel mounted on the spindle, a housing which encloses the rotary vessel and is connected to the base, and a liquid supply duct for supplying the rotary vessel with liquid to be filtered, characterised in that the rotary vessel has an open top and comprises filter material extending to a weir at its upper edge, and the housing includes a passageway adjacent and communicating with the weir to enable discharge of waste material which does not pass through the filter material during supply of liquid to be filtered to the inlet passage and rotation of the rotary vessel.

By provision of an open topped rotary vessel, particulate material which is typically retained on the inner surface of such a vessel is automatically propelled to the top and then guided over the adjoining weir, thus expelled from the vessel, while clean liquid drains through because the vessel wall comprises filter material.

In preferred embodiments of the invention, the spindle has an axial bore and an outlet therefrom into the bottom of the rotary vessel. Liquid to be filtered is supplied from the liquid supply duct, which is provided in the base, to the bore of the spindle and subsequently through the outlet and into the rotary vessel.

Preferably the rotary vessel is of inverted frusto-conical form, tapering from the upper edge downward. In other words, it is configured like a funnel, but in this case, in preferred embodiments, liquid enters at the bottom. However, in other embodiments within the scope of the invention the rotary vessel may be of different configuration, such as barrel shaped or bowl shaped, possibly with stepped or undulating increase in diameter towards the upper edge. The filter material is suitably of metal or plastics and of mesh or of perforated sheet material. Also, in other embodiments, liquid may enter from above, from the top of the funnel, or at a Mead location (although the latter is less likely owing to more complex design).

In preferred embodiments of centrifugal separators in accordance with the invention, a form of baffle means is provided in the rotary vessel to guide and distribute liquid emerging from the outlet of the spindle bore upwards along an inner surface of the filter material of the rotary vessel. This improves the efficiency of operation. Such baffle means may comprise a plate disposed to have a substantially planar surface thereof facing the, or each, liquid outlet from the bore of the spindle.

In preferred embodiments of the invention the weir is annular. Also in preferred embodiments the housing is preferably designed so that the passageway therein extends fully around an upper region of the housing so as to receive material from any location around the weir, whether or not it is of annular form. Typically, the passageway will extend radially outwards of the weir relative to the axis of the spindle. However, it could be positioned to extend at least partially below the weir.

The passageway suitably includes at least one downwardly inclined surface serving as a chute for discharge of the waste material. In preferred embodiments a part helical path for such a discharge chute is provided. It is yet further preferred that two, symmetrically arranged, part helical chutes are provided.

The present invention encompasses centrifugal separators which are self-driven by means of the liquid which flows through in order to have particulate contaminant materials removed therefrom, and also centrifugal separators which have external power supply for rotation of the rotary vessel. This distinction has already been referred to in previous passages above. In embodiments of the invention which are self-powered, the rotary vessel may be provided with a drive member having nozzles supplied with liquid to be filtered from the axial bore of the spindle so that the rotary vessel is caused to rotate by reaction to liquid emission from said nozzles. Such an arrangement is conventional for self-powered centrifugal separators. There are typically one or more pairs of symmetrically arranged nozzles so that the motion of the rotor is evenly balanced.

However, in contrast to such a conventional arrangement of drive nozzles, in a development of the present invention, applicable to preferred embodiments of a self-driven type of centrifugal separator, it has been found advantageous that the rotary vessel be provided with a drive member having only a single nozzle supplied with liquid to be filtered from the axial bore of the spindle. Whilst this tends to cause some imbalance in the rotation of the vessel, the vibration which results assists in propelling the retained contaminant material upwards over the inner surface of the rotary vessel for discharge to the weir at the upper edge of the vessel.

A second aspect of the present invention concerns a method of separating solid contaminants from a liquid comprising: providing a centrifugal separator having a base, a substantially vertical spindle upstanding from the base, a rotary vessel which is mounted on the spindle and has an open top and which comprises a filter material extending to a weir at its upper edge, and a housing which encloses the rotary vessel and is connected to the base and which includes a passageway adjacent and communicating with the weir; supplying the rotary vessel with liquid to be filtered through a liquid supply duct; and rotating the rotary vessel so that, owing to centrifugal force, waste material which does not pass through the filter material is discharged from the rotary vessel over the weir to the adjoining passageway in the housing

BRIEF DESCRIPTION OF THE DRAWINGS

The invention will be described further, by way of example, with reference to the accompanying drawings, in which.

DESCRIPTION OF PREFFERED EMBODIMENTS

Figure 1:
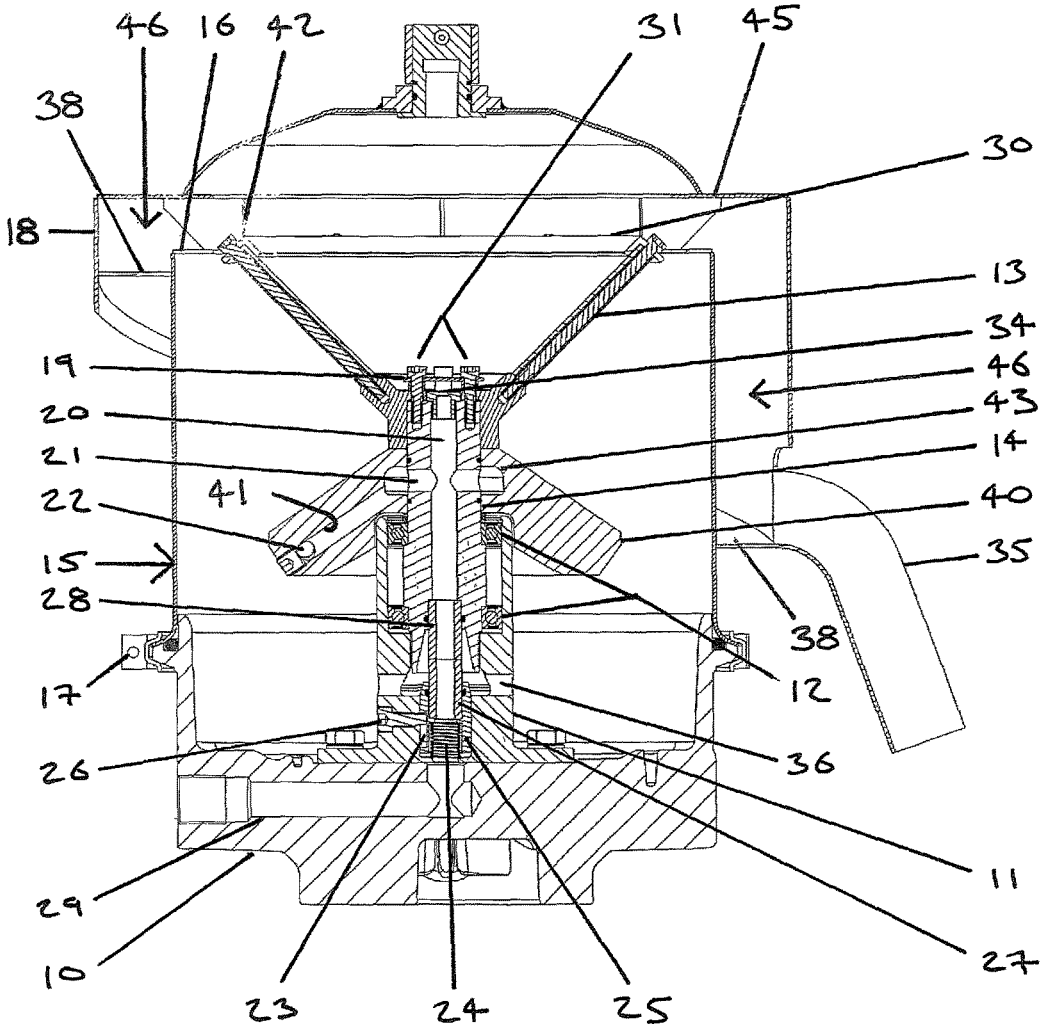
FIG. 1 is a longitudinal cross section of a preferred practical embodiment of a self-powered centrifugal separator according to the present invention.
Figure 2:
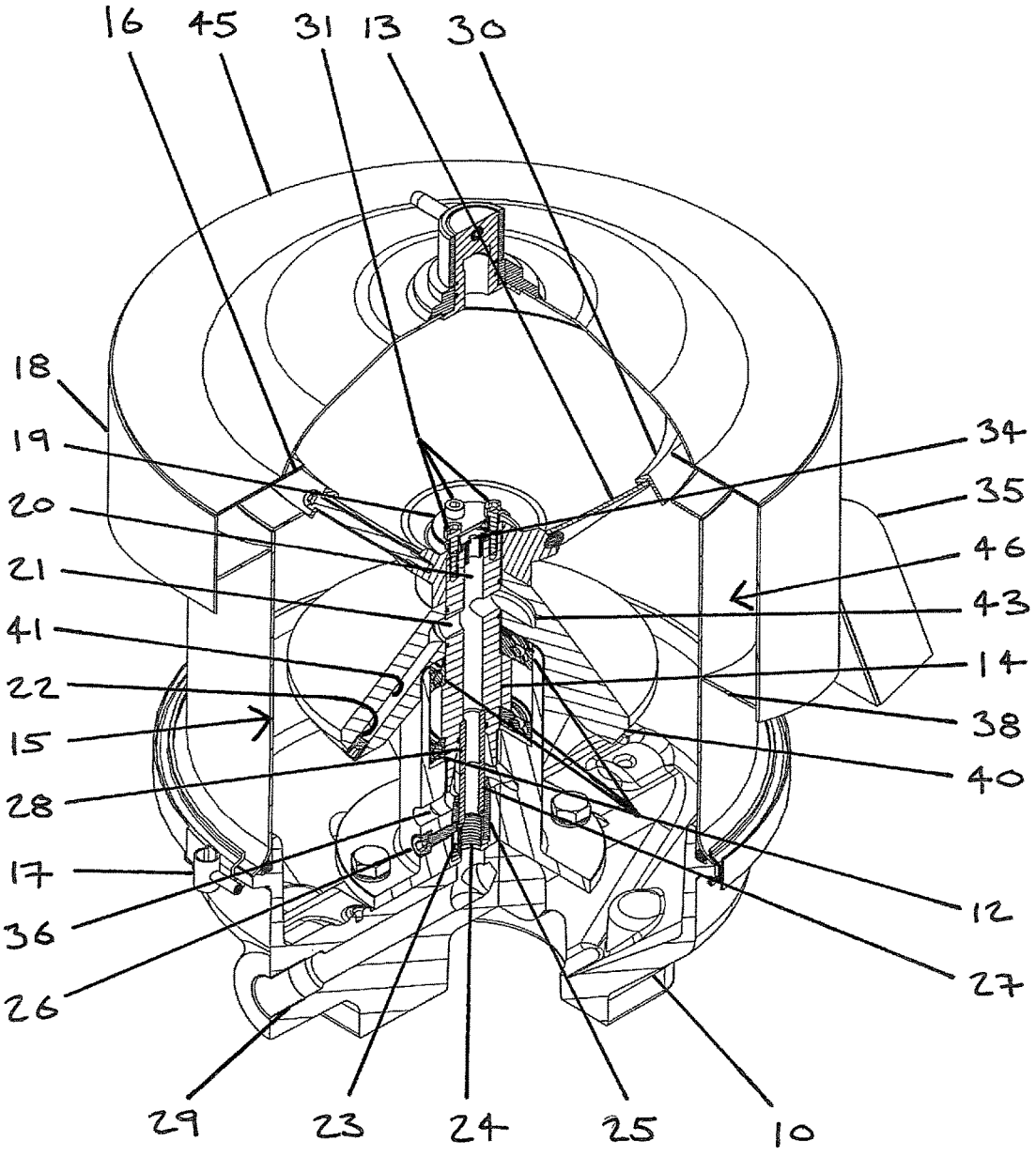
FIG. 2 is a perspective view from above, and partially sectioned, of the same embodiment as FIG. 1.
Figure 3:
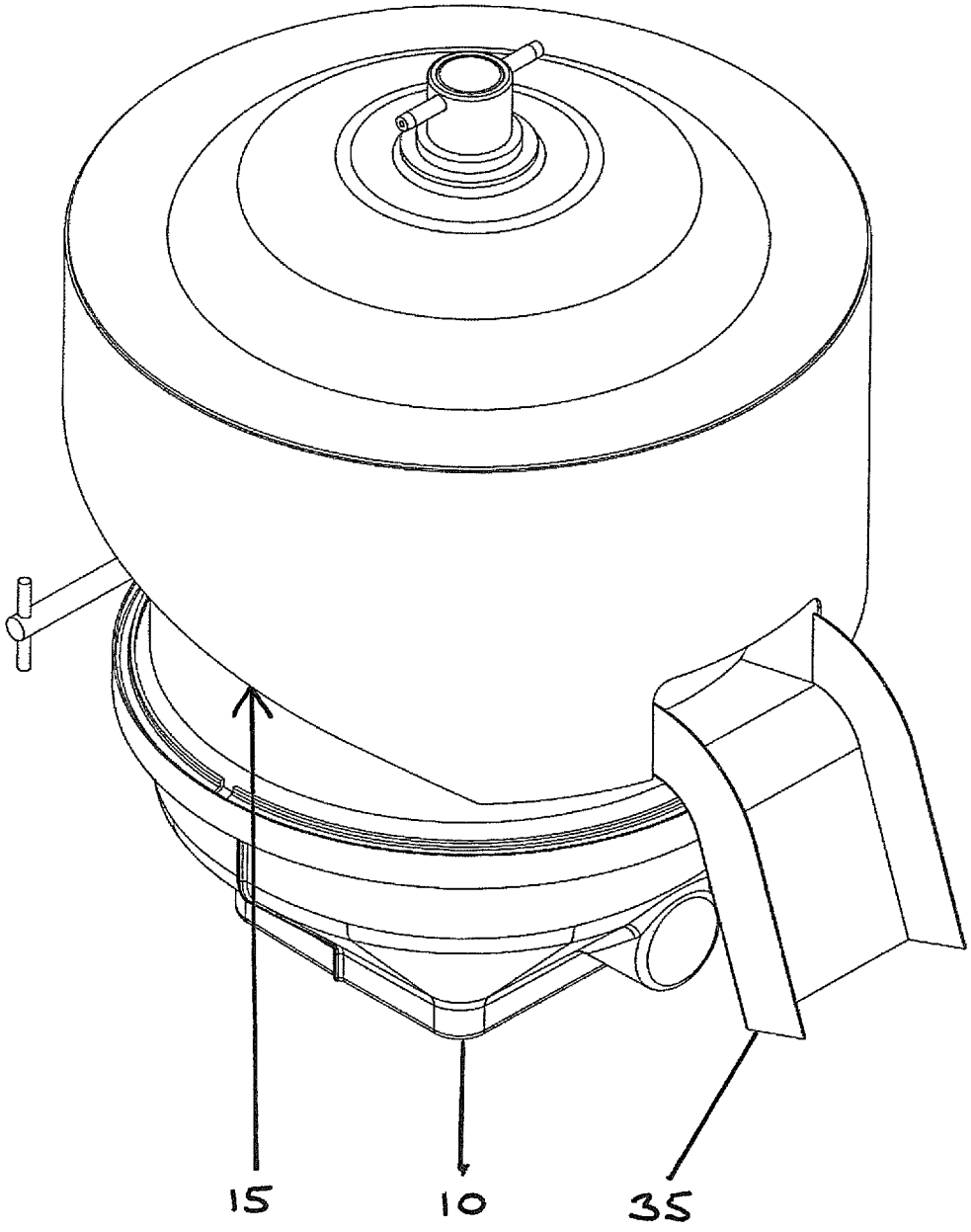
FIG. 3 is a perspective view of the same embodiment approximately at right angles to the view in FIG. 2.

FIGS. 1 to 3 show a preferred practical embodiment of a self-powered centrifugal separator comprising a base 10, on which a rigidly fixed bearing housing 11 locates two rolling element bearings 12. The bearings 12 support, locate and allow rotation of an open ended inverted frusto-conical rotary vessel 13 about the axis of a vertical spindle 14, upon which the rotary vessel 13 is mounted. The rotary vessel 13 widens outwards from its lower end to an annular weir 30 at its open upper end. The rotary vessel 13 is made from a filter material in the form of mesh or perforated sheet material. In the exemplary embodiment, a mesh with apertures measuring between 5 and 50 micro meters has been found to be suitable. However, the exact size of the apertures will depend on the application of the centrifuge and may differ from the range of sizes specified for the exemplary embodiment.

An axial bore 20 extends through the length of the spindle 14 with an outlet 34 at the upper end of the bore 20 to the bottom of the funnel shaped vessel 13. The axial bore 20 joins with a through bore 21 formed at right angles to the bore 20. A drive member 40 which is shaped somewhat like an inverted disc or bowl is mounted onto the spindle 14 at a position overlying the through bore 21. This drive member 40 is rigidly attached to the spindle 14 and the vessel 13 so that these components rotate in unison. The transverse through bore 21 communicates with an annular channel 43 in the drive member 40 and a single radial passage 41 in the drive member 40 leads from this channel 43 to a single outlet nozzle 22.

A baffle plate 19, in the form of a substantially planar plate, is provided inside the rotary vessel 13 adjacent the outlet 34. This plate 19 is fixed in position by an arrangement of four screws 31.

A rotor housing 15 is mounted over the rotary vessel 13 and is secured to the base 10 by means of a clamp 17. The housing 15 includes a substantially annular shelf 16 adjacent and at a narrow spacing radially outward of the weir 30. The housing 15 also includes an outer sleeve portion 18 which, together with the shelf 16 and a downwardly inclined wall 38 connecting to a main upright wall of the housing 15, defines a passageway 46 for discharge of material retained in the rotary vessel 13, as will be described hereafter. Thus the passageway 46 extends radially outwards relative to the axis of the spindle 14. The downwardly inclined wall 38 is of part helical shape and leads in a downward direction from the upper end of the rotor housing 15 adjacent the weir 30 to a discharge chute 35 at a lower level of the housing exterior. Although it is not apparent in the drawings, the housing design preferably includes two symmetrically arranged downwardly inclined walls 38 from an upper end of the passageway 46. A plurality of circumferentially spaced fins 42 are provided extending from and below a top wall 45 of the housing 15 and connecting to the shelf 16 as a measure for strengthening the housing 15.

A seal sleeve 25 is fitted into a lower section of the bearing housing 11 and is free to slide in the vertical sense. Rotation of the seal sleeve 25 is prevented by a screw 26 which extends through the bearing housing 11 and engages into a vertical slot 23 in the seal sleeve 25. The engagement of the screw 26 into the seal sleeve 25 also serves to prevent the seal sleeve 25 from departing the bearing housing 11 in the vertical sense. In this respect the seal sleeve 25 is forced in an upward direction by fluid pressure forces and additionally by a compressed spring 24 which is located in the bottom of the seal sleeve 25 and acts between it and the bearing housing 11.

An axial sealing arrangement is provided between the spindle 14 and the bearing housing 11. This sealing arrangement comprises a tubular lower seal component 27 which is fitted coaxially into the seal sleeve 25 and a tubular upper seal component 28 which is fixed coaxially into the lower end of the spindle 14. The interface between these seal components 27, 28 is below the level of both the bearings 12 in the bearing housing 11. The force acting on the seal sleeve 25 by virtue of the spring 24 is transmitted to the upper face of the lower seal component 27 which bears against the lower face of the upper seal component 28 (end-to-end sealing contact). In operation of the centrifuge, the upper seal component 28 is, of course, rotating because it is fixed into the lower end of the rotating spindle 14, while the lower seal component 27 remains stationary as it is fixed against rotation in the sleeve 25, which is also, as already explained, mounted to be non-rotatable in the bearing housing 11.

A liquid supply duct 29 extends through the base 10 to enable supply of liquid from an inlet to the bore of the lower seal component 27 via the axial passages of the spring 24 and the seal sleeve 25. The passageway for liquid extends via the axial bore of the rotating upper seal component 28 and the axial bore 20 of the spindle 14 to the transverse bore 21 of the spindle 14. From here a portion of the liquid will pass to the nozzle 22 and enter the enclosure of the rotor housing 15 and a portion of the liquid will exit through the outlet 34 at the top of the spindle 14 and enter the rotary vessel 13.

The force of the spring 24 prevents the majority of supplied liquid from the supply duct 29 from escaping from the interface between the lower seal component 27 and the rotating upper seal component 28. That liquid which may escape from the interface between the lower seal component 27 and the rotating upper seal component 28 can drain to the base 10 via bores 36 in the bearing housing 11. Moreover, components mounting the sealing arrangement 27, 28, such as the lower end of the spindle 14 and the seal sleeve 25 in the illustrated example, or any other intermediate mount in other embodiments, are configured to direct liquid leaking from the interface downwards towards the drainage openings (bores 36) in the bearing housing 11 from where it passes into the base 10 of the centrifuge.

The lower seal component 27 and the rotating upper seal component 28 need to be made from suitably durable material to adequately resist abrasion from the particulate matter contained within the supplied liquid. In particular, the seal interface must be sufficiently wear resistant to maintain long operating periods between repair or changing of the seal components and it must provide low friction to minimise drive losses on the rotor. Ceramic material has been found suitable for the cylindrical seal components 27, 28, but other material or material combinations may also prove suitable.

As already outlined, in use a proportion of the contaminated liquid from which particulate material is to be separated is emitted via the nozzle 22 with the remaining portion of contaminated liquid being emitted via the outlet 34 at the upper end of the spindle 14. The pressure of the liquid and its tangential emission via the nozzle 22 causes rotation of the drive member 40 which in turn drives the rotor vessel 13. The portion of the contaminated liquid, which is emitted via the outlet 34 at the upper end of the spindle 14, emerges into the rotary vessel 13 and is guided and distributed by the baffle plate 19 to progress upwards along the inner surface of the filter material of the vessel 13. Liquid per se drains through the filter material depositing the particulate contaminant matter on the inner surface of the filter material. In the exemplary embodiment, a liquid flow rate between 40 and 75 liters per minute has been found to provide an adequate supply of liquid to be portioned between the rotary vessel 13 and the nozzle 22. However, the flow rate employed is highly dependent on the application of and the exact size of the separator, so in other practical embodiments, flow rates may be outside the 40 to 75 liters per minute which is appropriate for the exemplary embodiment.

The particulate matter retained inside the rotary vessel 13 is still wet and sludge like and, owing to the rotation of the vessel, and the centrifugal force generated, assisted by the shape of the vessel 13 and the provision of the baffle, it is transported upwardly over the inner surface of the filter material. When it reaches the weir 30 it is discharged from the rotary vessel 13 onto the shelf 16 of the housing and from there down the passageway 46 and on to the disposal chute 35. This transportation of the concentrated, separated contaminant material is assisted by vibration of the centrifuge caused by an imbalance of rotation which results from the tangential emission of liquid via the single nozzle 22.

The liquid which has drained through the filter material (clean liquid) enters the enclosure of the rotor housing 15 and mixes with the contaminated liquid emitted via the nozzle 22. The resulting liquid mixture drains from the base 10 to a sump (not shown) and may be re-circulated to the inlet of the conduit 29. This configuration allows the centrifuge to steadily reduce the contaminant level over time and with multiple passes of liquid through the rotary vessel 13. The continual discharge of contaminant material allows for prolonged operation of the centrifuge with fewer breaks in operation for maintenance compared to typical centrifugal separators.

The invention is not restricted to the details of the foregoing embodiment and many variations in design detail are possible within the scope of the appended claims. For example, in respect to the provision of a single nozzle, it would be possible in alternative embodiments to provide multiple nozzles in a manner which would still cause an imbalance in the rotation of the vessel and achieve advantageous vibration. Also, in other embodiments the centrifugal separator may not be self-powered and, instead, rotation of the rotary vessel may be realised by means of an electric motor or similar. Another possible variation from the preferred embodiment is where liquid to be filtered, which is supplied to the rotary vessel, is not supplied through a base and a bore within an axial spindle. In an alternative arrangement the liquid could be supplied directly into the open top of the rotary vessel. It may also be possible to omit the spring which forces the seal sleeve in an upward direction in the lower section of the bearing housing. Instead, the fluid force of the liquid flowing through the sleeve may be relied upon to be sufficient to achieve the same ends.

What is claimed is:

1. A centrifugal separator comprising:

a base;

a substantially vertical spindle upstanding from the base in an axial direction, the spindle enclosing an axial bore conducting a liquid to be filtered, the axial bore having an outlet opening arranged on an upper axial end of the spindle;

a rotary vessel mounted on the spindle at a position proximate to the upper axial end of the spindle with the outlet opening at an interior of the rotary vessel;

a housing connected to the base and enclosing the rotary vessel, the housing having a liquid supply duct configured to supply the liquid to be filtered to the rotary vessel by way of the axial bore of the spindle;

the rotary vessel having an open top and an upper edge at the open top;

the rotary vessel comprising a filter material and further comprising a weir arranged at the upper edge, wherein the filter material extends upwardly to the weir;

the housing comprising a passageway arranged adjacent to the weir and communicating with the weir to enable discharge of waste material, the waste material contained in the liquid to be filtered and not passing through the filter material during supply of liquid to be filtered to the rotary vessel and rotation of the rotary vessel;

a baffle plate fixed onto the upper axial end of the spindle facing the outlet opening of the axial bore, the baffle plate arranged at an interior of the rotary vessel, the baffle plate deflecting and guiding liquid to be filtered from the outlet opening onto an inner surface of the filter material of the rotary vessel to progress upwards along the inner surface of the filter material to the weir.

2. The centrifugal separator according to claim 1, wherein the liquid supply duct is a passage extending through the base and communicating with the axial bore of the spindle.

3. The centrifugal separator according to claim 1, wherein the outlet opening faces and discharges against the baffle plate to supply liquid to be filtered to a bottom of the rotary vessel.

4. The centrifugal separator according to claim 3, wherein the baffle plate is substantially planar and radially extending surface facing the outlet opening, extending radially in the interior of the rotary vessel at the bottom of the rotary vessel.

5. The centrifugal separator according to claim 1, wherein the spindle further includes a traverse bore formed at right angles to and connected to the axial bore, the traverse bore opening though a radially outer side of the spindle;

a single nozzle forming a drive member, the single nozzle mounted onto the radially outer side of the spindle at a position overlying the traverse bore, the single nozzle ejecting a portion of the liquid to be filtered into the housing, the drive member driving the rotary vessel and spindle to rotate in unison, the drive member causing the rotary vessel to rotate by reaction to emission of the liquid to be filtered from the single nozzle.

6. The centrifugal separator according to claim 5, wherein an unbalanced rotational drive of the rotary vessel by the drive member having only the single nozzle produces an imbalanced rotation or vibration in the rotation of the rotary vessel, urging the waste material upwards over the inner surface of the rotary vessel for discharge to the weir at the upper edge of the vessel.

7. The centrifugal separator according to claim 1, wherein the passageway of the housing extends around an upper region of the housing.

8. The centrifugal separator according to claim 1, wherein the passageway of the housing extends radially outwards of the weir relative to an axis of the spindle.

9. The centrifugal separator according to claim 1, wherein the passageway of the housing comprises at least one downwardly inclined surface as a chute configured to discharge the waste material.

10. The centrifugal separator according to claim 1, wherein the rotary vessel has an inverted frusto-conical form tapering from the upper edge in a downward direction to a bottom of the rotary vessel.

11. The centrifugal separator according to claim 1, wherein the filter material is a mesh or a perforated sheet material.

12. The centrifugal separator according to claim 1, further comprising a bearing housing fixedly mounted on the base and further comprising bearings disposed in the bearing housing, the bearings supporting the spindle for rotation of the spindle relative to the base, wherein the spindle is connected to the rotary vessel so as to rotate in unison with the rotary vessel relative to the base.

13. The centrifugal separator according to claim 12, further comprising a sealing arrangement providing a sealing action between the spindle and the base, wherein the sealing arrangement is separate from the bearings and disposed at a location below the bearings inside the bearing housing.

14. The centrifugal separator according to claim 13, wherein the sealing arrangement is an axial sealing arrangement.

15. The centrifugal separator according to claim 14, wherein the axial sealing arrangement is spring-loaded.

16. The centrifugal separator according to claim 15, wherein the axial sealing arrangement comprises upper and lower cylindrical seal components arranged in an end-to-end sealing contact relative to each other, wherein at least one of the upper and lower cylindrical seal components is spring-loaded to effect the end-to-end sealing contact.

17. A method of separating solid contaminants from a liquid, the method comprising:

providing a centrifugal separator comprising a base, a substantially vertical spindle upstanding from the base in an axial direction, the spindle enclosing an axial bore conducting a liquid to be filtered, the axial bore having an outlet opening arranged on an upper axial end of the spindle, a rotary vessel mounted on the spindle at a position proximate to the upper axial end of the spindle with the outlet opening at an interior of the rotary vessel, and a housing connected to the base and enclosing the rotary vessel, the housing having a liquid supply duct configured to supply the liquid to be filtered to the rotary vessel by way of the axial bore of the spindle, wherein the rotary vessel has an open top and an upper edge at the open top, wherein the rotary vessel comprises a filter material and further comprises a weir arranged at the upper edge, wherein the filter material extends upwardly to the weir, wherein the housing comprises a passageway arranged adjacent to the weir and communicating with the weir, and wherein a baffle plate is fixed onto the upper axial end of the spindle facing the outlet opening of the axial bore, the baffle plate arranged at an interior of the rotary vessel, the baffle plate deflecting and guiding liquid to be filtered from the outlet opening onto an inner surface of the filter material of the rotary vessel to progress upwards along the inner surface of the filter material to the weir;

supplying the rotary vessel with a liquid to be filtered through the axial bore of the spindle;

ejecting the liquid to be filtered through the outlet opening at the upper axial end of the spindle against the baffle plate;

deflecting the liquid to be filtered on the baffle plate onto the inner surface of the filter material; and rotating the rotary vessel so that waste material, contained in the liquid to be filtered and not passing through the filter material, is discharged by centrifugal force from the rotary vessel across the weir to the passageway of the housing.

18. The method according to claim 17, wherein, in the step of supplying, the liquid to be filtered is supplied to the rotary vessel from the liquid supply duct via the axial bore provided in the spindle and via the outlet opening connected to the axial bore and opening into the rotary vessel at a bottom of the rotary vessel.

19. The method according to claim 17, wherein, in the step of supplying, the liquid to be filtered is supplied from the liquid supply duct through an open top of the substantially vertical spindle into a bottom of the rotary vessel.

* * * * *